United States Patent [19]

Leini

[11] Patent Number: 4,924,577

[45] Date of Patent: May 15, 1990

[54] CHAINSAW GUIDEBAR

[75] Inventor: Arvo Leini, Granvagen, Sweden

[73] Assignee: Sandvik AB, Sandviken, Sweden

[21] Appl. No.: 204,283

[22] Filed: Jun. 9, 1988

[30] Foreign Application Priority Data

Jun. 10, 1987 [SE] Sweden ..... 8702402

[51] Int. Cl.[5] ..... B27B 17/02

[52] U.S. Cl. ..... 30/387; 30/383

[58] Field of Search ..... 30/387, 384, 383; 83/820, 821, 825

[56] References Cited

U.S. PATENT DOCUMENTS

| | | | |
|---|---|---|---|
| 596,802 | 1/1898 | Brown et al. . | |
| 2,693,206 | 11/1954 | Anttonen . | |
| 2,888,964 | 6/1959 | Mall . | |
| 2,897,856 | 8/1959 | Carlton | 30/387 |
| 2,948,309 | 8/1960 | Hoff et al. | 30/387 |
| 3,191,646 | 6/1965 | Merz | 30/387 |
| 3,762,047 | 10/1973 | Scott-Jackson | 30/385 |
| 3,955,279 | 5/1976 | Pierson | 30/384 |
| 3,987,544 | 10/1976 | Gibson | 83/825 |
| 4,259,783 | 4/1981 | Scott-Jackson et al. | 30/384 |
| 4,381,606 | 5/1983 | Ekrud et al. | 30/387 |
| 4,489,493 | 12/1984 | Tsumura | 83/821 X |
| 4,561,181 | 12/1985 | Weisgerber | 30/387 |
| 4,611,401 | 9/1986 | Piller | 30/387 |
| 4,651,424 | 3/1987 | Yamada | 30/387 |

FOREIGN PATENT DOCUMENTS

| | | |
|---|---|---|
| 201979 | 2/1966 | Sweden . |
| 433468 | 5/1984 | Sweden . |

*Primary Examiner*—Frank T. Yost
*Assistant Examiner*—Rinaldi Rada
*Attorney, Agent, or Firm*—Burns, Doane, Swecker & Mathis

[57] ABSTRACT

A chainsaw guidebar comprises an elongate guidebar body replaceably secured to a nose part. The guidebar body is provided with a central extension, the shape of which matches a corresponding forwardly tapering recess in the nose part. Portions of the nose part longitudinally overlap portions of the guidebar body.

6 Claims, 1 Drawing Sheet

CHAINSAW GUIDEBAR

BACKGROUND AND OBJECTS OF THE INVENTION

This invention is a guidebar for chainsaws of a kind comprising an elongated guidebar body and releasably secured to this a nose part. The guidebar body being provided with a groove running along its edge to receive and guide a saw chain. The nose part being secured to the guidebar body by riveting and having side plates supporting a nose sprocket. The side plates are shaped so that location of the nose part and the guidebar body are relative to each other, during and after riveting to provide an uninterrupted support for the saw chain.

In the front end of a guide bar where the saw chain travels around the nose part, it is common that one attempts to minimize friction and wear either by coating the guidebar with a material with high wear resistance, or by letting the chain be supported by a smooth or toothed nose sprocket. The toothed sprocket is preferred because one can be sure that it rotates even if its bearing runs stiffer than normal due to cold or fouling.

The nose part, the nose sprocket and its bearing are more exposed to damage than other parts of the guidebar, and there are many designs of guidebars, where the nose part including the nose sprocket and its bearing is made as a separate unit, secured to the remaining bar body with rivets. Examples of this are known from U.S. Pat. No. 596,802, No. 2,888,964 and No. 3,762,047. The rivets can easily be removed for change of nose part. Nose parts without sprockets can also be made as replaceable units as in Swedish Patent 201.979.

In all designs with a replaceable nose part, it is desirable with consideration of vibrations, wear and safety, that the saw chain is continuously guided by the guidebar without deviations from the plane of the guidebar, and that it is supported without interruptions, at least not along those parts of the guidebar where the saw chain can be engaged in cutting. Thus it is common that at the joint between the nose part and the guidebar body the contours of the plates involved are shaped to include some locating surfaces on tongues or recesses in the main direction of the guidebar. This minimizes the rise of dislocation during riveting, but this requires either very high precision for the lateral dimensions of the tongues, or a smoothing operation such as filing or grinding of the guidebar edge after riveting of the joint. Such designs for replaceable nose parts are known from U.S. Pat. Nos. 2,693,206, 2,888,964, 3,762,047, Swedish Patents 201.979, 433.468.

A different way to shape the locating surfaces is to let them form a large angle with the longitudinal axis of the guidebar, 45 degrees or more, as is shown in U.S. Pat. Nos. 3,955,279, and 4,489,493. This has the advantage of being rather insensitive to deviations in the shape of the contour, allowing the contour to be blanked with no finishing operation, or even that the plates of the nose part and the bar body are originally made as one integral piece, separated by blanking of the joint contour without loss of material, although both parts become slightly broadened by the slanting direction of the blanked surface. However, the larger angle has the disadvantage of imprecise locating at right angles to the guidebar axis, and the risk of sideways dislocation during riveting is great, especially by replacement, when the rivet holes might have become expanded. Because of this guidebars of these types must often be made with chamfered edges near the joint, which implies a length where the chain is inadequately supported.

A modification of the designs shown in U.S. Pat. No. 3,955,279 with a more strongly curved contour, or U.S. Pat. No. 4,489,493 with a smaller angle between the locating surfaces and the longitudinal axis would result in a more precise lateral position, but also in lower strength of the rearwards extending corners of the nose part, and a larger variation in longitudinal position with rise of inadequate support for the chain when traversing the joint.

It is also previously known to make the contour of the joint unsymmetrical with respect to the longitudinal axis of the guidebar, to make the joints in the two outer layers or two outer plates at the same guidebar edge longitudinally offset, giving the chain support on at least one side all the way as shown in U.S. Pat. No. 4,259,783 and Swedish Patent 433,468. These designs imply, however, that some of the rivets only pass through one of the outer plates of the nose part, leading to a high risk of a buckled or twisted joint with the nose part and the guidebar body in different planes, especially if a nose part is replaced with hand riveting in primitive conditions. This would be a safety problem, because the drive links of the saw chain could become stuck or expelled when traversing the joint.

The present invention concerns a guidebar with replaceable nose part, where the joint between the guidebar body and the nose part has been shaped with such a contour, that the contour may be blanked without a finishing operation; that the nose part and the guidebar body can be made from plates which have been integral but separated by blanking; that the chain is always supported on at least one side; that the corners of the nose part have adequate strength; and that the nose part and the guidebar body will always be in the same plane even after a primitively performed riveting.

In more detail, the invention is characterized by the rear contour of the outer plates of the nose part being shaped to comprise two rearwardly pointing extensions and between them one forwardly tapering recess with at least partly straight locating surfaces for contact with the guidebar body. The locating surfaces of said recess are preferably so oriented that they form an acute angle with the longitudinal axis of the guidebar between 10 degrees and 40 degrees.

THE DRAWINGS

In the following, one embodiment of the invention will be described with reference to the accompanying drawings, wherein FIG. 1 shows an elongated guidebar body and a nose part according to one possible embodiment of the invention. FIG. 2 shows the same parts as FIG. 1 but seen from above or below. FIG. 3 shows a joined-together guidebar in an alternative embodiment of the invention.

DETAILED DESCRIPTION OF A PREFERRED EMBODIMENT OF THE INVENTION

Figure 1:
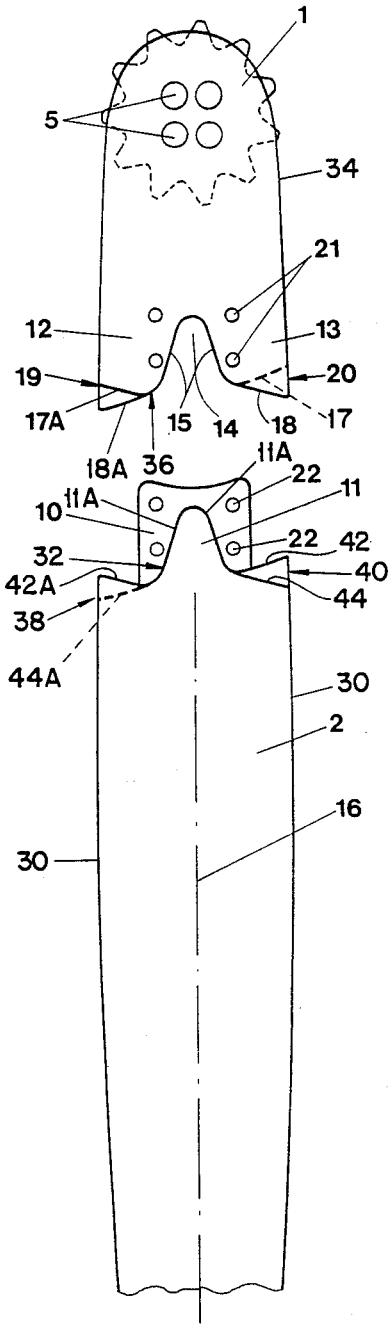
Figure 2:
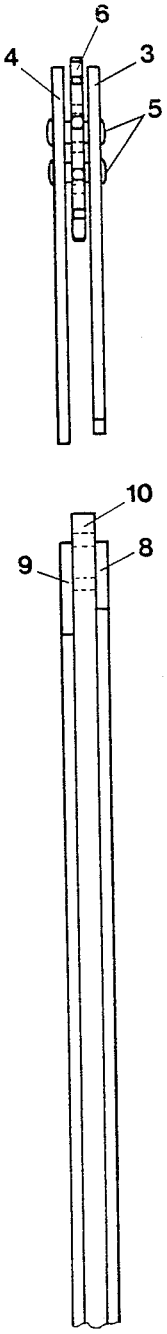
Figure 3:
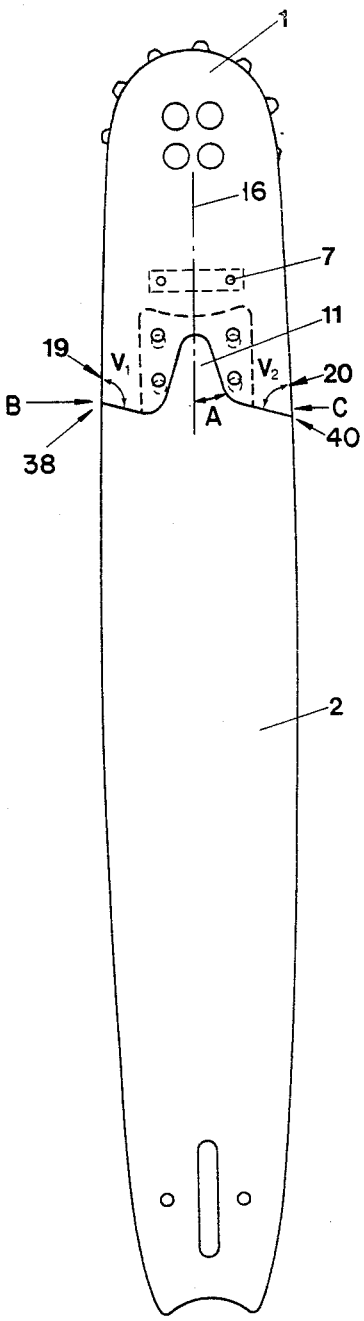

A guidebar according to the invention consists of a nose part (1) and a guidebar body (2). The nose part (1) comprises superimposed outer plates (3, 4) the rear end of which has been given such a contour, that they in cooperation with the guidebar body (2) provide the lateral locating of the parts. The outer plates (3, 4) of the nose part (1) are held together by rivets (5) passing through a bearing center for a nose sprocket (6) journalled between those plates. Beside this the nose part may also comprise a middle plate (7) riveted between the outer plates (3, 4), but this central plate need not have any function for locating the nose part (1) in relation to the guidebar body (2).

The guidebar body (2) may as one alternative comprise three plates held together by spot welds, the superimposed outer plates (8, 9) of which have been given a contour matching that of the outer plates (3, 4) of the nose part (1), and the middle core plate (10) extends in front of the outer plates (8, 9) to enter a space formed between the outer parts (3, 4) of the nose part (1). The body (2) includes longitiudinally extending outer peripheral edges (30), laterally spaced front ends of which are interconnected by a forwardly facing connecting edge (32). The nose part (1) includes an outer peripheral edge (34), laterally spaced rear ends of which are interconnected by a rearwardly facing connecting edge (36). The outer plates (8, 9) have also each been provided with a central extension or tongue (11) with forwardly tapering shape and softly rounded end. The extension (11) has lateral locating straight surfaces (11A) to match a corresponding central recess (14) in the nose part (1). When the guidebar body (2) and nose part (1) are assembled, the core plate (10) extends forward beyond the bottom of the central recess (14) in the nose part.

Alternatively the guidebar body (2) could be made from a single thicker plate, from which the surface layers have been removed by milling in regions with contours matching the contour of the outer plates (3, 4) of the nose part, and where the remaining thickness between the removed portions coincides with the distance between the outer plates (3, 4).

The contour of the outer plates (3, 4) at the joints contains for each plate two rearwardly pointing extensions (12, 13) forming therebetween a recess (14) which is tapering forwards. The recess (14) is delimited by at least partly straight locating surfaces (15) which are symmetrically placed relative to the longitudinal axis (16) of the guidebar and which form an angle (A) with this axis between 10 degrees and 40 degrees, preferably between 15 degrees and 20 degrees.

The nose part includes first and second laterally spaced sections (19, 20) separated by the recess (14). The first section (19) includes first and second edge portions (17A, 18A) which are spaced apart in a direction perpendicular to the plane of the nose part. The second section (20) also includes first and second edge portions (17, 18) which are similarly spaced apart. The first edge portions (17, 17A) are inclined forwardly and outwardly, and the second edge portions (18, 18A) are inclined rearwardly and outwardly. A forwardly inclined edge portion (17 or 17A) of one section is coplanar with a rearwardly inclined edge portion (18 or 18A) of the other section.

The forwardly facing connecting edge (32) includes laterally spaced third and fourth sections (38, 40) separated by the extension (11). The third and fourth sections (38, 40) mate with the first and second section (19, 20), respectively. The third section (38) includes third and fourth edge portions (42A, 44A) which are spaced apart in a direction perpendicular to the plane of the body (2). The fourth section (40) also includes third and fourth edge portions (42, 44) which are similarly spaced apart. The third edge portions (42, 42A) are inclined forwardly and outwardly, and the fourth edge portions (44, 44A) are inclined rearwardly and outwardly. The forwardly inclined edge portion (42A) of the third section (38) is coplanar with the rearwardly inclined edge portion (44) of the fourth section (40). The third edge portions (42, 42A) engage the first edge portions (17, 17A), and the fourth edge portions (44, 44A) engage the second edge portions (18, 18A) when the body (2) and nose part (1) are assembled. Thus, the first and third sections (19, 38) longitudinally overlap one another at a laterally outer location (B), and the second and fourth sections (20, 40) longitudinally overlap one another at a laterally outer location (C). The forwardly inclined edge portions (17, 17A) form an angle V1 with adjacent portions of the outer peripheral edge (34), which angle V1 is different from the angle V2 which the rearwardly inclined edge portions (18, 18A) form with that edge (34). Since the joints are longitudinally overlapping relative to each other, the chain is always supported on at least one side. The angles (V1, V2) should be chosen as well over 45 degrees, to avoid any possibility that the edge portions (17, 18) could become parallel to the front or rear slope of the drive links. Preferably, the angles (V1, V2) are chosen between 60 degrees and 120 degrees. The longitudinal offset between the joints measured at the guidebar periphery should be less than the distance between rivets in the saw chain.

Those rivets (21) that connect the nose part (1) to the guidebar body (2) are symmetrically placed relative to the longitudinal axis (16) of the guidebar, and all of them pass through both sideplates (3, 4) of the nose part (1) and through the middle core plate (10) of the guidebar body (2), making all rivets symmetrically loaded with two shear planes. This ensures that the nose part (1) and the guidebar body (2) will always be in the same plane.

The rivet holes (22) in the core plate (10) should be rearwardly displaced in the longitudinal direction of the guidebar body (2) as far as corresponds to the diametrical play between the rivet hole and the rivet shank before the rivet is set. This will force the nose part (1) against the guidebar body (2) when the rivet is set, and lead to a rigid contact along the straight locating surfaces (15) of the recess (14), which locates the nose part (1) in relation to the guidebar body (2) both longitudinally and transversally.

I claim:

1. A chainsaw guidebar comprising a body and a nose part replaceably connected together to define a front-to-rear extending longitudinal axis, a forward end of said body being defined by a forwardly facing connecting edge of said body, a rearward end of said nose part being defined by a rearwardly facing connecting edge which mates with said forwardly facing connecting edge, said body including two longitudinally extending outer edges spaced from one another in a lateral direction relative to said axis, forward ends of said outer edges being interconnected by said forwardly facing connecting edge, said nose part includng two longitudinally extending outer edges spaced from one another in a lateral direction relative to said axis, rear ends of said outer edges of said nose part being interconnected by said rearwardly facing connecting edge, said outer edges of said body being aligned with respective outer edges of said nose part when said nose part is connected to said body so as to define first and second outer peripheral edges of said guidebar which are adapted to guide a movable sawchain, said rearwardly facing connecting edge including a front-to-rear extending recess which opens rearwardly toward said body, said forwardly facing connecting edge including a front-to-rear extending tongue received in said recess to define therewith a tongue-and-recess connection, said recess being defined by forwardly convergent linear first surface portions and said tongue including forwardly convergent linear second surface portions which engage said first surface portions, each of said first and second surface portions forming an acute angle with said axis in the range of 10 to 40 degrees, said forwardly facing connecting edge being in longitudinally overlapping relationship relative to said rearwardly facing connecting edge at two locations disposed on opposite lateral sides of said axis and separated by said tongue-and-recess connection, said rearwardly facing connecting edge including first and second sections situated at respective ones of said locations, each of said first and second sections including first and second edge portions spaced apart in a direction perpendicular to a plane of said guidebar, one of said first and second edge portions of each said section being inclined forwardly and laterally outwardly, and the other of said first and second edge portions of each said section being inclined rearwardly and laterally outwardly, said rearwardly and laterally outwardly inclined edge portion of each of said first and second sections being coplanar with said forwardly and laterally outwardly inclined edge portion of the other of said first and second sections, said forwardly facing connecting edge including laterally spaced third and fourth sections mating with said first and second sections, respectively, each of said third and fourth sections including third and fourth edge portions engaging said first and second edge portions, respectively, of an associated one of said first and second sections.

2. A chainsaw guidebar according to claim 1, wherein said angle is from 15 to 20 degrees.

3. A chainsaw guidebar according to claim 1, wherein each of said rearwardly and laterally outwardly inclined edge portions of said first and second sections forms a first angle with an adjacent outer edge of said nose part, each of said forwardly and laterally outwardly inclined edge portions of said first and second sections forming a second angle with an adjacent outer edge of said nose part, said first and second angles being of different sizes.

4. A chainsaw guidebar according to claim 3, wherein each of said first and second angles is from 60 to 120 degrees.

5. A chainsaw guidebar according to claim 1, wherein said nose part comprises two superimposed first plates defining a space therebetween, said body including two superimposed second plates arranged in coplanar relationship with respective ones of said first plates, said body including a core plate disposed between said second plates and projecting forwardly into said space, a plurality of fasteners joining said nose part to said body and passing through said first plates and said core plate.

6. A chainsaw guidebar according to claim 1, wherein each of said first plates contains one of said rearwardly and laterally outwardly inclined edge portions and one of said forwardly inclined and laterally outwardly edge portions, each of said second plates containing one of said rearwardly and laterally outwardly inclined edge portions and one of said forwardly and laterally outwardly inclined edge portions.

* * * * *